United States Patent [19]

Bell

[11] 4,381,911

[45] May 3, 1983

[54] PORTABLE HAND CONTROLLED CEMENT FINISHING MACHINE

[76] Inventor: Evans Bell, Bunnlevel, N.C. 28323

[21] Appl. No.: 26,328

[22] Filed: Apr. 2, 1979

[51] Int. Cl.[3] ..... A01J 21/00

[52] U.S. Cl. ..... 425/458; 51/102; 51/128; 51/170 T; 51/180

[58] Field of Search ..... 51/56 R, 102, 126, 170 T, 51/128, 180; 125/14; 425/458

[56] References Cited

U.S. PATENT DOCUMENTS

| | | | |
|---|---|---|---|
| 1,619,158 | 3/1927 | Schimmelpfenning | 51/102 |
| 1,692,997 | 11/1928 | Roberts | 51/126 |
| 2,055,404 | 9/1936 | Cushman | 51/126 |
| 2,075,369 | 3/1937 | Stetler | 51/180 |
| 2,298,228 | 10/1942 | Pond et al. | 51/180 |
| 2,828,587 | 4/1958 | Miller | 51/180 |
| 3,412,508 | 11/1968 | Schell | 51/128 |
| 3,629,978 | 12/1971 | Coes | 51/126 |
| 4,204,292 | 9/1980 | Lester et al. | 51/180 |
| 4,241,471 | 12/1980 | Elias | 51/126 |

FOREIGN PATENT DOCUMENTS

| | | | |
|---|---|---|---|
| 728266 | 7/1932 | France | 425/213 |
| 1195454 | 11/1959 | France | 51/180 |
| 428296 | 12/1947 | Italy | 51/126 |
| 447859 | of 1949 | Italy | 51/126 |
| 489543 | 1/1954 | Italy | 51/126 |
| 403459 | 12/1933 | United Kingdom | 51/126 |
| 518912 | 3/1940 | United Kingdom | 51/126 |
| 304339 | 6/1971 | U.S.S.R. | 51/180 |

*Primary Examiner*—Jay H. Woo
*Attorney, Agent, or Firm*—Mills and Coats

[57] ABSTRACT

The present invention relates to a relatively lightweight, portable, hand controlled finishing machine for finishing cement like surfaces. The cement finishing machine comprises an elongated shaft that makes up the main frame thereof, and a rotary wheel rotatively mounted to said elongated shaft and driven by an electric motor also mounted to said elongated shaft. Finishing elements such as rocks, brushes, or even trowels are detachably secured to an outer exposed radial face of said rotary wheel. In operation, the cement finishing machine is supported adjacent a wall or surface to be finished and during the course of operation, an operator is able to manipulate and control the main frame such that the finishing elements engage and act upon the surface being worked.

12 Claims, 6 Drawing Figures

PORTABLE HAND CONTROLLED CEMENT FINISHING MACHINE

The present invention relates to wall finishing machines and more particularly to a portable hand held cement finishing machine of the type having a rotary wheel where the finishing elements are disposed on the radial face thereof.

BACKGROUND OF THE INVENTION

Cement finishing of walls, ceilings and other surfaces has traditionally been done manually. This, obviously, is very difficult and laborious work, besides being quite inefficient. Due to the scarcity of labor, it has been and continues to be difficult to find willing workers skilled sufficiently to manually finish cement walls, ceilings and other cement surfaces.

Because of the difficulty and inefficiency of manually finishing cement walls, there has been attempts at providing automatic wall surfacing or finishing machines. Many of such are machines provided with a grinder or abrasive head that grinds down the wall or ceiling surfaces, as opposed to finishing freshly applied cement. For example, see the disclosures in U.S. Pat. Nos. 1,947,286; 751,820; 2,075,369; and 2,124,705.

As noted above, these machines are utilized for grinding down walls and surfaces and not for finishing work. Besides these machines are relatively large, bulky, complicated, expensive and awkward to maneuver.

SUMMARY OF INVENTION

The present invention is a cement finishing machine that is relatively simple and portable, and quite versatile as the same may be utilized to finish and smooth freshly applied cement, and to brush and/or clean wall surfaces of various types. The cement finishing machine basically comprises an elongated shaft that makes up the main frame and includes an electric motor mounted on said elongated shaft and drivingly interconnected to a rotary finishing wheel that is provided with a radial work face. Various finishing and working elements may be detachably mounted to the radial work face, such as finishing stones, trowel elements, brushes of various hardness and even sponges.

Also provided is a cable assembly that is mounted to said elongated shaft and which is operative to be suspended from an elevated point such that the portable cement finishing machine may hang vertically from a support point adjacent the working wall. To guide and control the cement finishing machine, the same includes a pair of handles adapted to be held and controlled by a operator such that the same can be swung along side the working wall by the operator in performing the finishing or cleaning work of the wall. In addition, the cement finishing machine of the present invention is provided with an auxiliary ceiling working attachment that enables the same to be supported adjacent the surface of a horizontal ceiling and moved therealong to achieve the work desired.

It is, therefore, an object of the present invention to provide a cement finishing machine that is simple in construction and easy to use, but which is effective and efficient.

Another object of the present invention resides in the provision of a cement finishing machine that is portable to the extent that it can easily be manipulated and operated by a single operator.

Still a further object of the present invention is to provide a cement finishing machine for finishing vertical walls that is supported from an elevated point by a cable assembly and which can be easily swung and moved along a vertical working wall by a single operator.

A further object of the present invention resides in the provision of a portable type cement finishing machine of the character described above that is versatile and which can be adapted to finish horizontal ceiling surfaces.

Another object of the present invention is to provide a cement finishing machine that is adapted to do numerous finishing and cleaning jobs such as smoothing freshly applied cement with trowel like elements, finishing freshly applied cement with stones so as to impart a finishing touch to the wall or surface being worked, and even cleaning a washed surface with brush or sponge elements.

Finally, it is an object of the present invention to provide a cement finishing machine with a unique vertical control design wherein the cement finishing machine is suspended by cable from an elevated point and wherein the machine is provided with handle means that extend from the main frame thereof that allows the operator to easily and conveniently move and manipulate the machine adjacent the surface being worked on.

Other objects and advantages of the present invention will become apparent from a study of the following description and the accompanying drawings which are merely illustrative of the present invention.

DESCRIPTION OF PREFERRED EMBODIMENT

Figure 1:
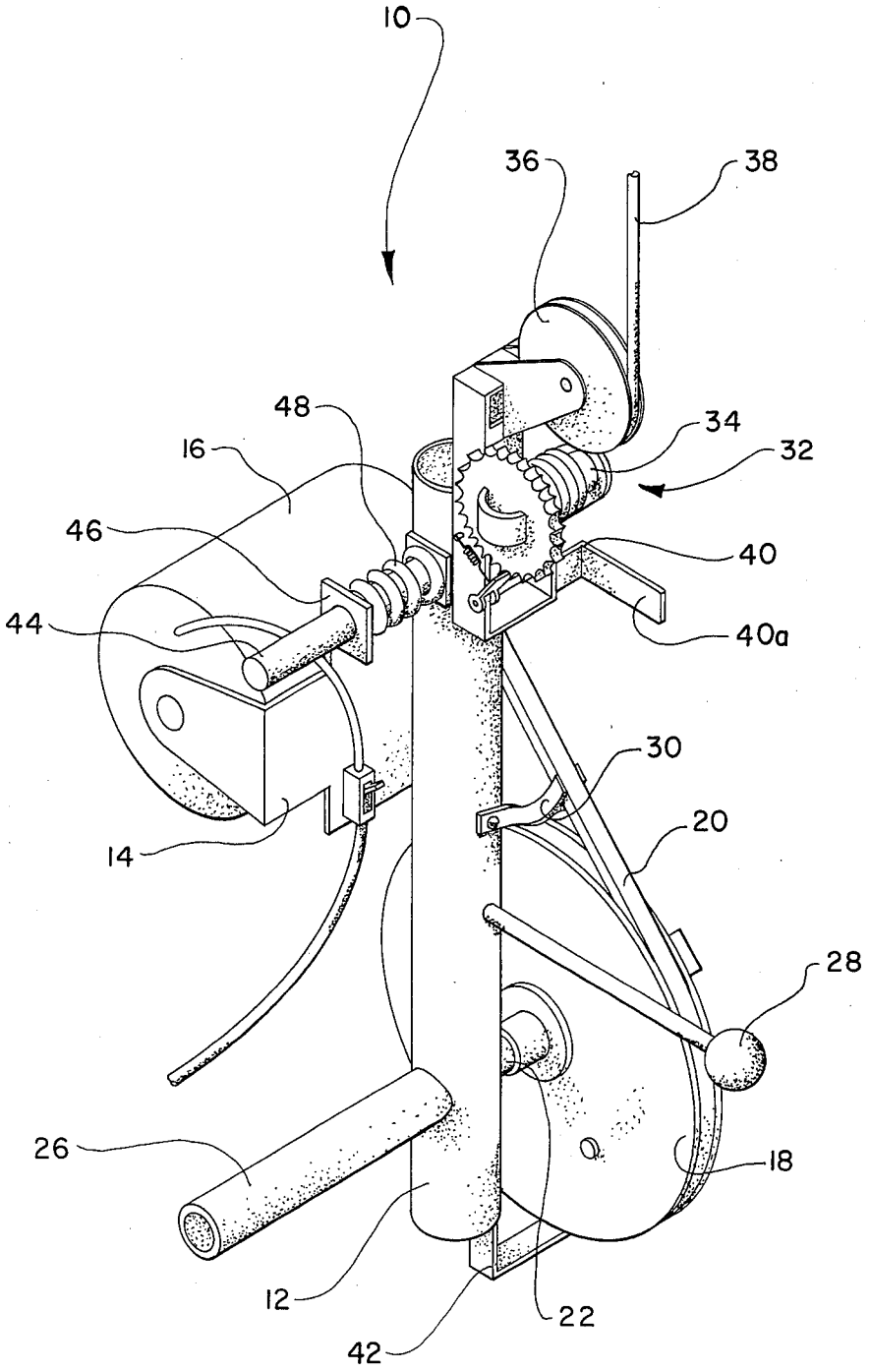
FIG. 1 is a perspective view of the cement finishing machine disposed in a vertical position for working adjacent a vertical wall.

With further reference to the drawings, the cement finishing machine of the present invention is shown in FIG. 1 and indicated generally by the numeral 10. Viewing cement finishing machine 10 in more detail, it is seen that the same includes a main frame structure that is formed by an elongated shaft 12 that has a motor mount 14 secured thereto. Secured within the motor mount 14 is an electric motor 16 that is adapted to drive a rotary work wheel 18 that is rotatively journaled on a transverse shaft 22 extending outwardly from the elongated main frame shaft 12.

Electric motor 16 includes an output sheave that has a V-belt 20 trained therearound with the V-belt 20 being further trained around the rotary work wheel 18 for driving the same.

Extending from elongated shaft 12 on the side thereof opposite the rotary work wheel 18 is a first handle 20 that includes a longitudinal axis disposed in general parallel alignment with the axis of transfer shaft 22. In the preferred embodiment first handle 20 is co-axially aligned with transverse shaft 22. In addition, a second handle 28 extends from elongated shaft 12 generally between the rotary work wheel 18 and the first handle 26. As seen in the drawings, second handle 28 is disposed such that it lies in a plane generally parallel to the rotary work wheel 18.

To maintain V-belt 20 clean, a belt cleaner 30 is secured to elongated shaft 12 and projects therefrom about the underside of the V-belt for cleaning the same while the cement finishing machine 10 is being operated.

To provide the main support for the cement finishing machine 10 while the same is being used in a vertical orientation as shown in FIG. 1, a cable assembly, indicated generally by the numeral 32, is secured about the upper end of the elongated shaft 12. Cable assembly 32 includes a ratchet reel 34 that stores the cable 38 thereabout. In a typical operation, the cable 38 extends from the ratchet reel 34 around an idler 36 to an elevated point where the same is attached. The operator of the cement finishing machine can adjust its vertical position by accordingly adjusting the ratchet reel 34.

To maintain the cement finishing machine 10 in a proper orientation with respect to the surface being worked, there is provided squaring means that extend from the main frame 12 about the rotary work wheel for generally maintaining the outer radial work face 24 thereof in parallel relationship to the wall or surface being worked. In this regard the squaring means includes a generally L-shaped bracket 40 that extends above the rotary work wheel 18 as oriented in FIG. 1 and a lower bracket 42 that extends from the lower end of the elongated shaft 12 outwardly adjacent the lower terminal edge of the rotary work wheel 18. In the case of L-shaped bracket 40, it is seen that the same includes an angled leg 40*a* that is designed to engage the work surface. Similarly bracket 42 includes an outer terminal edge that also engages the work surface, and it follows that the outer extension distance of both brackets 40 and 42 could be adjusted to accommodate the particular type of finishing or working elements carried by the rotary work wheel 18.

Figure 6:
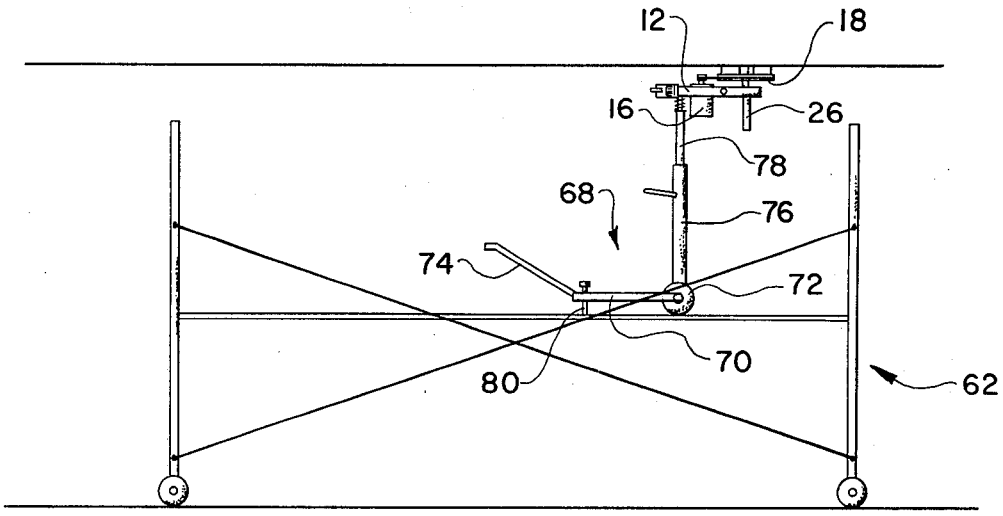
FIG. 6 is a front elevational view of the cement finishing machine mounted to the auxiliary ceiling support assembly for supporting the cement finishing machine in a position adjacent a horizontal ceiling for finishing the same.

From subsequent portions of this disclosure, it will be seen that the cement finishing machine 10 of the present invention can be utilized to finish, smooth or do a selected type of work on a horizontal ceiling, as illustrated in FIG. 6. To accommodate this feature of the present invention, the cement finishing machine 10 includes a stub shaft 44 that includes a stop 46 that is axially movable along the stub shaft 44, and a spring 48 interposed between the stop 46 and the elongated shaft 12. This is particularly shown in FIG. 1 and it is observed that stub shaft 44 extends in parallel relationship to the transverse shaft 22 supporting the rotary work wheel 18.

Figure 2:
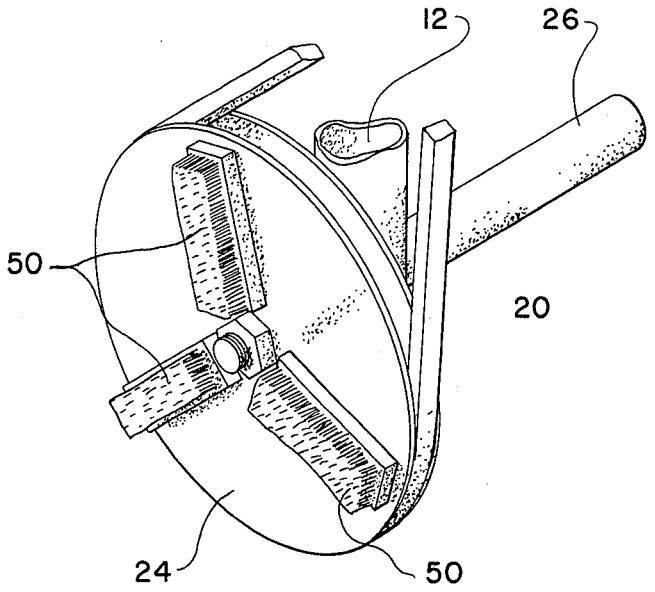
FIGS. 2, 4 and 5 are fragmentary perspective views of the rotary working wheel of the cement finishing machine of the present invention, illustrating various working elements attached to the outer radial working face of the rotary wheel.
Figure 4:
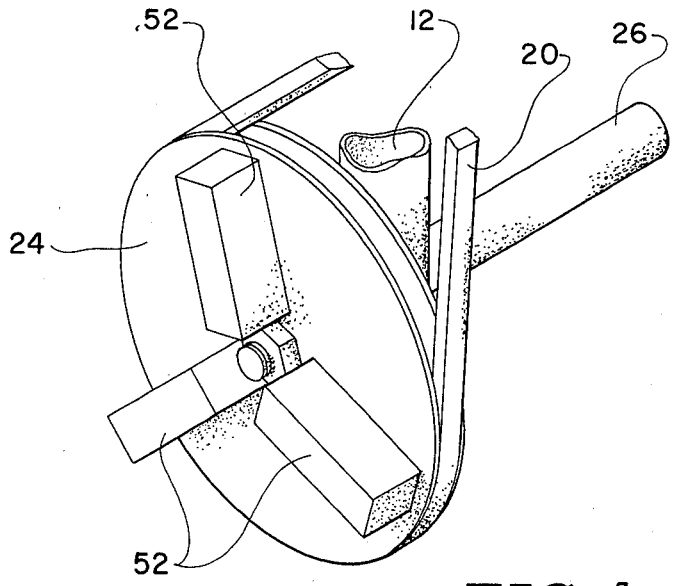
Figure 5:
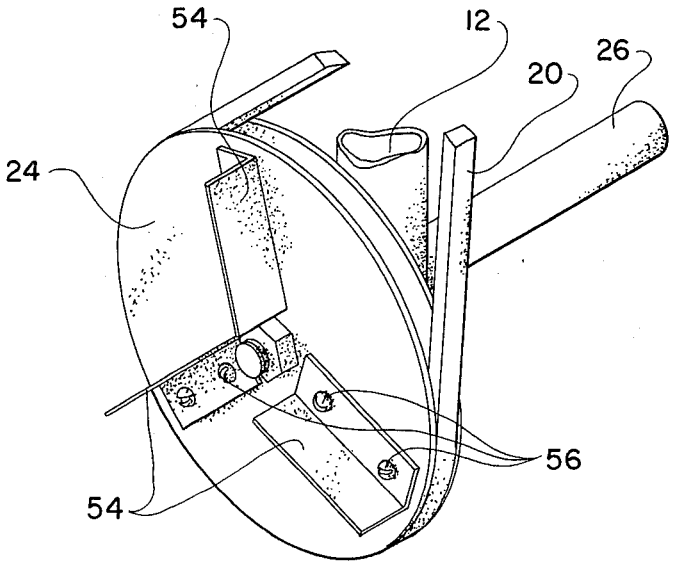

Turning to FIGS. 2, 4 and 5, it is seen that the rotary work wheel 18 includes an exposed outer radial work surface 24. The finishing machine 10 of the present invention is particularly adapted and designed to perform numerous wall finishing and related jobs.

For example, in FIG. 5, a series of three trowel elements 54 are attachably secured to the outer radial face 24 by detachable securing means in the form of screws 56. These trowel elements 54 can be utilized to smooth and spread cement or plaster type material over a work surface, such as a wall or ceiling.

In FIG. 4, the outer radial work surface 24 is shown with a plurality of radially disposed rubbing stones or rocks secured thereto. Although not particularly shown in the preferred embodiment, it is contemplated that by the use of flanges along the edges of the stones or other suitable attaching means, that the same could be attached in a detachable manner to the outer radial face in a manner similar to that illustrated in FIG. 5. The stones could be made from cement or sand, and are typically of the type referred to as copper rind stones. In use, these rubbing stones can be utilized to finish a cement or plaster type wall after the cement has been separated over the work surface. The stones are utilized to engage the outer surface and to gently smooth and grind the surface to a desired texture and thickness.

In FIG. 2, the working element shown are a series of radially disposed brushes 50 that could be of any selected hardness for brushing or washing a wall or ceiling or surface.

Figure 3:
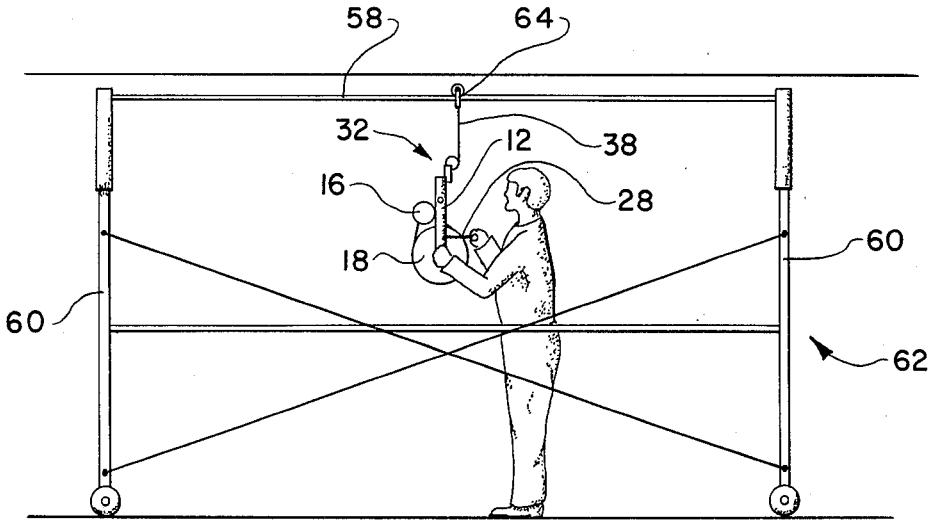
FIG. 3 is a front elevational view illustrating the suspension structure for supporting the cement finishing machine from an elevated point by a scaffold and cable assembly.

In using the cement finishing machine 10 of the present invention on a vertical wall or work surface, the present invention contemplates that the remote end of the cable 38 would be tied to an elevated point about the structure, such as a top portion of the wall or structure being worked on. In addition, another typical suspension system is shown in FIG. 3, and in this case a horizontal runner 58 is secured and supported by spaced apart posts 60 which, in this case, form a part of a scaffold structure indicated generally by the numeral 62. Secured about the runner 58 is a trolly hanger 64 that includes means for attaching cable 38 thereto. Consequently, as illustrated in FIG. 3, the operator can move the trolly hanger 64 along the runner 58 thereby being able to reach certain areas between the post 60 of the scaffold 62. The operator can further position the cement finishing machine 10 by adjusting the ratchet reel 34 so as to raise and lower the cement finishing machine with respect to the horizontal runner 58. In addition, it is appreciated that the scaffel can be mobile, as illustrated in FIG. 3, and moved along the side of the working wall or surface.

Hereinabove it was noted that cement finishing machine 10 can be utilized to work and finish a ceiling surface. This is particularly illustrated in FIG. 6, and as shown therein, to accomplish this there is provided a dolly 68 having a platform 70 that is adapted to move along a horizontal support surface by wheels 72. A handle 74 is secured to the dolly 68 and extends therefrom while as shown in FIG. 6, an adjustable jack 80 can be utilized to horizontally level the dolly 68 when stationary.

Secured to the platform and extending upwardly therefrom is a main support shaft 76. Supported within the main support shaft 76 is an adjustable intermediate support shaft 78 that can be raised up and down with respect to the dolly 68 and can be locked and stationed within shaft 76 at selected heights. Upper intermediate shaft 78 is particularly adapted to receive the outer end of stub shaft 46 so as to support the cement finishing machine in a horizontal orientation for ceiling work, as indicated in FIG. 6. The presence of the spring 48 in conjunction with the dolly and support shafts 76 and 78 assures that the working surface of the rotary work wheel 18 can be firmly maintained in engagement with the ceiling. When so disposed, an operator can swing the main frame 12 and the cement finishing machine 10 in an arcuate path about the vertical axis of stub shaft 44. To cover the entire ceiling, the operator would move the dolly 68 from one position to another after the ceiling had been finished in one particular position.

From the foregoing specification, it is seen that the present invention presents a very unique, lightweight and generally portable cement finishing machine 10. Of prime importance, is the versatility of the cement finishing machine because it can be utilized to work on both horizontal and vertical surfaces and can perform numerous types of jobs on each, ranging from smoothing and finishing cement and plaster type surfaces to actually cleaning them. Another advantage to the cement finishing machine 10 of the present invention is that it is relatively simple in construction, easy to operate and can be handled and controlled by a single operator.

The terms "upper", "lower", "forward", "rearward", etc. have been used herein merely for the convenience of the foregoing specification and in the appended claims to describe the portable hand controlled cement finishing machine and its parts as oriented in the drawings. It is to be understood, however, that these terms are in no way limiting to the invention since the portable hand controlled cement finishing machine may obviously be disposed in many different positions when in actual use.

The present invention, of course, may be carried out in other specific ways than those herein set forth without departing from the spirit and essential characteristics of the invention. The present embodiment are, therefore, to be considered in all respects as illustrative and not restrictive, and all changes coming within the meaning and equivalency range of the appended claims are intended to be embraced therein.

What is claimed is:

1. A portable hand held and controlled cement finishing machine comprising:

(a) a main frame structure including an elongated shaft;

(b) a transverse shaft secured to said elongated shaft and extending outwardly therefrom;

(c) a rotary wheel rotatively journaled on said transverse shaft and rotatable thereon and including an outer radial face;

(d) mounting means secured to said elongated shaft of said main frame at a selected distance from said rotary wheel;

(e) power means mounted on said mounting means;

(f) drive means drivingly interconnecting said power means with said rotary wheel;

(g) finishing means secured to said outer radial face of said rotary wheel for engaging a surface being finished and imparting a finishing action to the surface as said rotary wheel is driven;

(h) a first handle secured to said elongated shaft on the side opposite said rotary wheel and extending outwardly therefrom and in general parallel relationship with said transverse shaft supporting said rotary wheel;

(i) a second handle secured to said elongated shaft in the vicinity of said first handle and extending therefrom;

(j) a cable assembly secured to said main frame for supporting said finishing machine from a selected height while the same is guided and controlled by an operator through said first and second handles; and (k) squaring arms mounted to said elongated shaft and extending outwardly therefrom on opposite sides of said rotary wheel for squaring the rotary wheel and said finishing means with a surface being finished.

2. The cement finishing machine of claim 1 wherein said finishing machine further includes a ceiling support stud shaft assembly secured to said elongated shaft on the side thereof opposite said rotary wheel and in general parallel alignment with said transverse shaft that supports said rotary wheel.

3. The cement finishing machine of claim 2 wherein said ceiling support stud shaft comprises a shaft, a stop collar disposed intermediately on said shaft, and spring means wound around the shaft and disposed intermediately between said stop collar and said elongated shaft of said main frame.

4. The cement finishing machine of claim 3 wherein said finishing means includes stone means secured to said rotary wheel by detachable securing means.

5. The cement finishing machine of claim 4 wherein the same includes a plurality of brush means that are detachably mounted to the outer radial face of said rotary wheel.

6. The cement finishing machine of claim 4 wherein the same further includes brush means detachably secured to said outer face of said rotary wheel.

7. The cement finishing machine of claim 3 wherein said drive means interconnecting said power means and said rotary wheel includes a V-belt, and wherein said cement finishing machine includes a belt cleaner secured to said elongated shaft and extending therefrom about said V-belt for cleaning the same while the rotary wheel is driven.

8. The cement finishing machine of claim 7 wherein said first handle includes an elongated shaft extending in co-axial alignment with said transverse shaft supporting said rotary wheel; and wherein said second handle is also elongated and secured to said elongated shaft generally between said first handle and said rotary wheel.

9. The cement finishing machine of claim 8 wherein said squaring means includes a first generally L-shaped bracket that is secured to said elongated shaft and extends outwardly therefrom on the same side as said rotary wheel for engaging the surface being worked or finished, and wherein said squaring means further includes a second bracket means fixed to said elongated shaft on the opposite side of said rotary wheel and extends outwardly therefrom a distance equal to the extension of said first bracket means such that said first and second brackets cooperate to maintain said rotary wheel and said finishing means in an appropriate position with respect to the surface being finished or worked.

10. A versatile portable hand held and hand controllable cement finishing machine for finishing walls and ceilings comprising: a frame structure having an elongated shaft; a rotary wheel rotatively mounted to said elongated shaft and including an outer radial face; cement finishing element means secured to the outer radial face of said rotary wheel for engaging and finishing a cemented surface; a power source mounted to said main frame structure in spaced apart and off set relationship relative to said rotary wheel; drive means drivingly interconnecting said power source and said rotary wheel for driving the latter; a cable assembly mounted to one end of said frame structure and including a cable that is generally secured to an elevated point such that the cement finishing machine is suspended along a working wall; handle means secured to said main frame structure and extending therefrom for enabling an operator to guide and control the cable suspended cement finishing machine along a certain wall being worked, said handle means including a first handle extending outwardly from said elongated shaft opposite said rotary wheel about an axis that extends perpendicular to the plane of said rotary wheel and a second handle extending from said frame structure at an angle to said first handle and in a plane generally parallel to said rotary wheel, wherein said first and second handles cooperate with said cable assembly to form the total support and guidance control of said finishing machine; means secured to said elongated shaft and projecting outwardly therefrom about said rotary wheel for maintaining the cement finish machine and rotary wheel in proper parallel alignment with a surface being worked; a ceiling finishing attachment including a stud shaft assembly adapted to be fixed to said elongated shaft opposite said rotary wheel and in parallel alignment with the axis of rotation of said rotary wheel; a vertical support post operative to fit and align with said stud shaft assembly such that the radial face of said rotary wheel may be maintained adjacent a ceiling surface; and dolly means having said vertical support post secured thereto such that the cement finishing machine when supported through said vertical support post and said dolly means may be moved about the ceiling surface by moving said dolly means.

11. The cement finishing machine of claim 10 further including a generally horizontal support run extending between upright support members; and wherein said cable assembly includes means for attaching the cable thereof to said run in order that said cement finishing machine can be suspended vertically from said run and may be moved along the working surface between said upright support members.

12. The cement finishing machine of claim 10 wherein there is provided detachable securing means for securing said finishing element means to said outer radial face of said rotary wheel; and wherein said cement finishing machine is provided with attachable stones, cement trowel elements, and brush means.

* * * * *